US008042478B2

(12) United States Patent
Oxley et al.

(10) Patent No.: US 8,042,478 B2
(45) Date of Patent: Oct. 25, 2011

(54) AUTOMATIC PANEL CUTTING AND SEAMING SYSTEM

(75) Inventors: Warran Oxley, Auburn, GA (US); John S. Chamlee, Lawrenceville, GA (US); Van H. Nguyen, Lawrenceville, GA (US); Danny V. Murphy, Dacula, GA (US)

(73) Assignee: Atlanta Attachment Co., Lawrenceville, GA (US)

( * ) Notice: Subject to any disclaimer, the term of this patent is extended or adjusted under 35 U.S.C. 154(b) by 552 days.

(21) Appl. No.: 12/207,819

(22) Filed: Sep. 10, 2008

(65) Prior Publication Data

US 2009/0064911 A1 Mar. 12, 2009

Related U.S. Application Data

(60) Provisional application No. 60/971,018, filed on Sep. 10, 2007.

(51) Int. Cl.
*D05B 11/00* (2006.01)
*D05B 27/10* (2006.01)
*D05B 37/00* (2006.01)

(52) U.S. Cl. . 112/2.1; 112/122.1; 112/304; 112/470.12; 83/676; 83/937

(58) Field of Classification Search ..... 112/122–130, 112/303–322; 83/471, 676, 910, 936–939
See application file for complete search history.

(56) References Cited

U.S. PATENT DOCUMENTS 2,076,178 A 4/1937 Eames
3,773,002 A 11/1973 Burton
3,839,973 A * 10/1974 Cummins et al. ..... 112/470.12
3,990,374 A 11/1976 Heidt
4,013,027 A 3/1977 Cash
4,019,447 A 4/1977 Blessing et al.
4,117,790 A 10/1978 Hasegawa et al.
4,125,079 A 11/1978 Black
4,181,085 A 1/1980 Conner, Jr.
4,457,243 A * 7/1984 Bowditch ..... 112/470.12
4,776,579 A 10/1988 Romand et al.
4,893,574 A 1/1990 O'Neal et al.

(Continued)

FOREIGN PATENT DOCUMENTS

EP 0 136 639 4/1985

(Continued)

OTHER PUBLICATIONS

Global Systems Group, NAHTEC, KL-222 Quilted Panel Cutting and Sewing Station, Brochure, date and author unknown.

(Continued)

*Primary Examiner* — Ismael Izaguirre
(74) *Attorney, Agent, or Firm* — Womble Carlyle Sandridge & Rice PLLC

(57) ABSTRACT

An automatic panel cutting and edge seaming system includes a series of side edge cutting and seaming assemblies that receive a fabric material and trim and sew seams along the side edges of the fabric material to form a desired width panel. Puller rolls pull the material through the side edge cutting and seaming assemblies and feed the trimmed and seamed fabric material to a cross-cut sewing assembly. After a sufficient length of fabric material has been fed to form a desired size panel, the cross-cut sewing assembly is engaged to cut and seam the end of the panel.

20 Claims, 9 Drawing Sheets

U.S. PATENT DOCUMENTS

| | | | | |
|---|---|---|---|---|
| 4,905,615 | A * | 3/1990 | Pofferi | 112/2.1 |
| 5,018,416 | A | 5/1991 | Freermann | |
| 5,040,473 | A | 8/1991 | Zesch et al. | |
| 5,249,540 | A * | 10/1993 | Sielemann | 112/304 |
| 5,483,909 | A | 1/1996 | Nogueras | |
| 5,529,004 | A | 6/1996 | Porter et al. | |
| 5,544,599 | A | 8/1996 | Frazer et al. | |
| 5,586,511 | A | 12/1996 | Porter et al. | |
| 5,816,177 | A | 10/1998 | Brocklehurst | |
| 5,913,277 | A | 6/1999 | Resta | |
| 5,915,319 | A | 6/1999 | Price et al. | |
| 5,943,971 | A | 8/1999 | Trickett et al. | |
| 6,000,352 | A | 12/1999 | Porter et al. | |
| 6,012,403 | A | 1/2000 | Codos et al. | |
| 6,237,517 | B1 | 5/2001 | Bondanza et al. | |
| 6,293,213 | B1 | 9/2001 | Block et al. | |
| 6,408,773 | B2 | 6/2002 | Resta | |
| 6,736,078 | B2 * | 5/2004 | Kaetterhenry et al. | 112/475.08 |
| 7,066,101 | B2 | 6/2006 | Codos | |
| 7,100,525 | B1 | 9/2006 | Price et al. | |
| 7,617,751 | B2 * | 11/2009 | James et al. | 83/33 |

FOREIGN PATENT DOCUMENTS

| | | |
|---|---|---|
| EP | 0220 368 | 5/1987 |
| GB | 1 384 073 | 2/1975 |
| IT | 1 183 122 | 10/1987 |
| JP | 7 308 465 | 11/1995 |

OTHER PUBLICATIONS

Mammut, Mammut MPS250 Accuracy and Speed, Brochure, date and author unknown.

Yamaichi, Tape Binding and Sewing Robot System, Y&Y-RB-A System, Brochure, date and author unknown.

* cited by examiner

AUTOMATIC PANEL CUTTING AND SEAMING SYSTEM

CROSS REFERENCE TO RELATED APPLICATIONS

This application claims the benefit of U.S. Provisional Application No. 60/971,018, entitled AUTOMATIC PANEL CUTTING AND SEAMING SYSTEM, filed Sep. 10, 2007, which application being incorporated herein by reference in its entirety.

FIELD OF THE INVENTION

The present invention generally relates to sewing systems and methods for forming mattresses, foundation sets and other, similar articles, and in particular, to a method of forming and seaming the longitudinal and lateral edges of a panel formed from a quilted material for use in forming the top panels of a mattress or other bedding component.

BACKGROUND OF THE INVENTION

In the manufacture of textiles, and in particular bedding, the sewing operations traditionally have been extremely labor intensive, manual operations that generally require highly skilled workers for cutting, sewing, finishing and assembling textile articles such as mattresses, foundation sets or other, similar articles. The more labor intensive the sewing operation and the greater the skill required of the operator(s) to cut, finish and assemble the components thereof, the greater the cost and the slower the production of such articles. For example, in the manufacture of mattresses, and especially in forming pillow-top or Euro-top type mattresses, a top panel that generally includes multiple fabric and/or cushion/foam layers, generally is cut to a desired size or length, such as for a king, queen, twin or other size mattress, and then is generally sewn to a flanging material. The panel then is applied over a spring set for the mattress, with the flanging material being pulled down over the side edge of the spring set and hog-ringed or stapled to a spring to secure the top panel of the mattress thereto. Thereafter, a border typically is attached about the sides of the mattress, covering the flanging material and springs, and a lower panel is attached, after which a tape edge is applied along the edges or seams between the top and bottom panels and the border.

Currently, there exist automatic systems that enable workers to measure, cut and sew borders, attachment gussets and other parts of a mattress or foundation. The drawback of such automated equipment, however, is that it typically has been limited in the type and number of sewing operations that can be performed. In addition, many operations in a bedding plant are often separated or spread apart so that the components typically are formed, cut and then compiled or transported to the next station for further processing or for storage until they can be finished and/or attached to other bedding components as needed. Such separation of the sewing or finishing stations is often due to the limited amount of space in the plant and ultimately leads to manufacturing inefficiencies.

Accordingly, it can be seen that a need exists for a system for finishing panels such as for mattresses, foundations, etc., that addresses the foregoing and other related and unrelated problems in the art.

SUMMARY OF THE INVENTION

The present invention generally relates to an automatic panel cutting and seaming system for sizing, cutting and seaming or sewing the edges of a fabric material to form a mattress panel or similar fabric product. As a quilted fabric material is output from an upstream single or multi-needle quilting machine, or from another supply source, the quilted material generally will be fed into the automatic panel cutting and seaming system of the present invention. The automatic panel cutting and seaming system thus can be a separate station located directly in-line with or immediately downstream from the outlet end of a quilting machine, so that as the quilted material passes therefrom, it is fed directly into and through the automatic panel cutting and seaming system. Additionally, the quilted material can be fed from other sources, such as one or more supply rolls for cutting and seaming to form a fabric panel of a desired size.

The automatic panel cutting and seaming station of the present invention generally will include a right-hand and a left-hand side edge cutting and seaming assembly, each having a sewing machine that engages and sews seams or lines of stitching along opposite sides of the quilted material as it is fed therethrough from the quilting machine. Generally, each of the side edge sewing machines will comprise conventional sewing machines having one or more spaced sewing needles that engage and sew along the side edges of the quilted material, and typically will include 1-2 (or more) overhead or top belt feed drive mechanisms for pulling the quilted material therethrough during sewing. Side sensors monitor the edges of the quilted material to ensure there is sufficient material being fed to each side edge sewing machine. Additionally, edge trimming blades or cutters positioned adjacent the sewing machines generally will trim away excess material outside the outer sewn seam or line of stitching. The side edge sewing machines and their associated edge trimming blades generally will be mounted on a carriage so as to be moveable laterally across the path of travel of the quilted material to a desired position with respect to the edges of the quilted material and can be disengaged from each other for service. A puller roll assembly additionally can be mounted adjacent the side edge cutting and seaming assemblies for engaging and pulling the quilted material through the automatic panel cutting and seaming system.

After a sufficient amount of quilted panel material has been fed into the automatic panel cutting and sewing system for a given panel size, as detected by sensors mounted along an output or feed table, a cross-cut sewing assembly generally will be activated. The cross-cut sewing assembly includes a clamp assembly that engages and holds the material taut, a collapsible bridge, and a multi-needle cross-cut sewing head that will move across the width of the panel to cut and sew the trailing edge of the finished panel. The multi-needle cross-cut sewing head is multi-directional and typically will include one-two pairs of spaced needles, one-two or more top belt feed drive mechanisms, and a cutting blade or trimmer approximately centrally located between the needles. As the multi-needle cross-cut sewing head is moved across the width of the quilted material, it cuts the quilted panel material, while at the same time the sewing needles thereof sew seams or lines of stitching adjacent the cut upstream and downstream side edges of the quilted panel material, thus forming seamed trailing and leading edges of the cut panel and the next panel to be formed. Once the cross-cut sewing head has moved across the quilted material, and cut the panel therefrom, it generally is pivoted approximately 180° to enable it to cut and sew the next panel as it moves back across the path of travel of the quilted material, without having to be reset or moved back across the path of travel of the quilted material to a start position on one side of the cross-cut sewing assembly. Sensors control the lateral movement of the cross-cut sewing head.

The cross-cut sewing head also can be positioned at various positions upstream or downstream from the left- and right-hand side-edge sewing machines so as to cut a panel of a desired length either before or after the side edges of the panels are cut and seamed/sewn. In one embodiment, the cross-cut sewing head can be positioned upstream from the right- and left-hand side edge sewing machines so as to cut and seam the longitudinal upstream and downstream edges of the panels, thus forming the panels of a desired length, prior to the panels being engaged by the side edge sewing machines. Such an arrangement can enable the shorter transitional waste, since the panel is already cut to a desired length, and substantially any width panel can be run at almost any time because of the side seaming/cutting locations. Alternatively, the cross-cut sewing machine can be positioned downstream from the side edge sewing machines so as to cut and sew the longitudinal edges of the panels after their side edges have already been cut and seamed. With such an arrangement, there can be a reduction in trim waste from the longitudinal, leading and trailing or upstream and downstream edges of the panels, although there may be additional transitional waste when running different width panels back to back.

Various features, objects, and advantages of the present invention will become apparent to those skilled in the art upon a review of the following Detailed Description, when taken in conjunction with the accompanying drawings.

DETAILED DESCRIPTION

Figure 1:
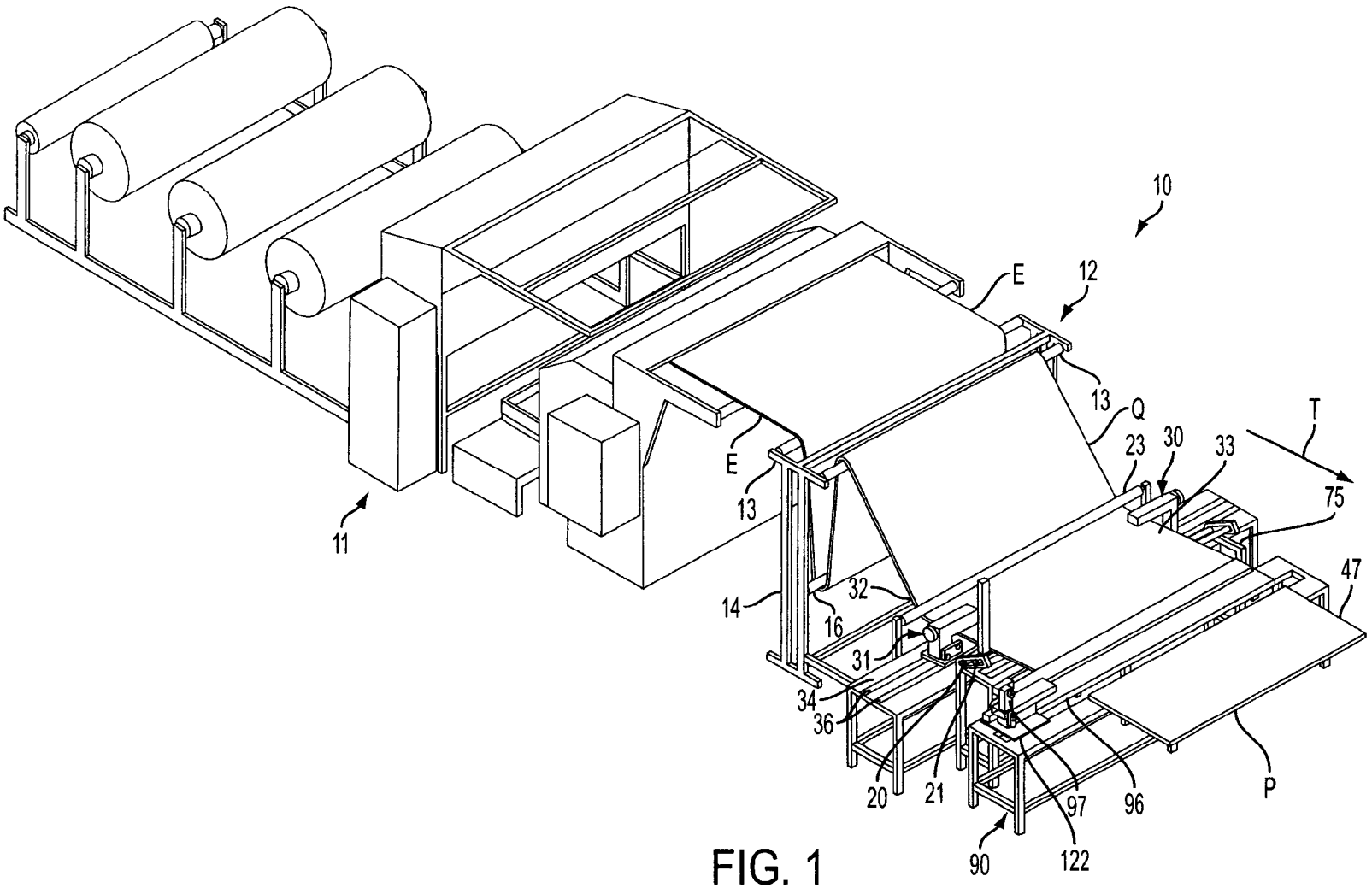
FIG. 1 is a perspective illustration showing the movement of a quilted material from a quilting machine to the automatic panel cutting and seaming system according to the principles of the present invention.

Referring now to the drawings in which like numerals indicate like parts throughout the several views, FIGS. 1-8 illustrate an automatic panel cutting and seaming system or station 10 for cutting and seaming the side and leading and trailing edges of a fabric material, such as quilted material Q shown in FIG. 1, for forming fabric panels, such as a mattress panel P, of desired sizes, such as for use in forming king size, queen size, double, twin, etc., size mattresses, or other similar products. FIGS. 9A and 9B schematically illustrate the operation of alternative embodiments of the automatic panel cutting and seaming system for forming panels of varying desired sizes.

As generally illustrated in FIG. 1, the quilted material Q can be received from an upstream source, such as a quilting machine 11, such as described and claimed in U.S. patent application Ser. No. 11/677,778, the disclosure of which is incorporated herein in its entirety, in which a fabric material is sewn and quilted to attach the various layers of the fabric material together and quilt or sew in various decorative pattern effects to form a quilted fabric material Q having a desired sewn pattern across its width. The automatic panel cutting and seaming system or station 10 thus can be mounted immediately downstream from the quilting machine 11 so as to receive the quilted fabric material Q directly therefrom as the quilted material is discharged from the quilting machine. Alternatively, other sources or supplies of a fabric material (which can be quilted or unquilted) can be provided, including feeding the quilted fabric material from one or more supply rolls mounted upstream from the automatic panel cutting and seaming system 10.

Figure 2:
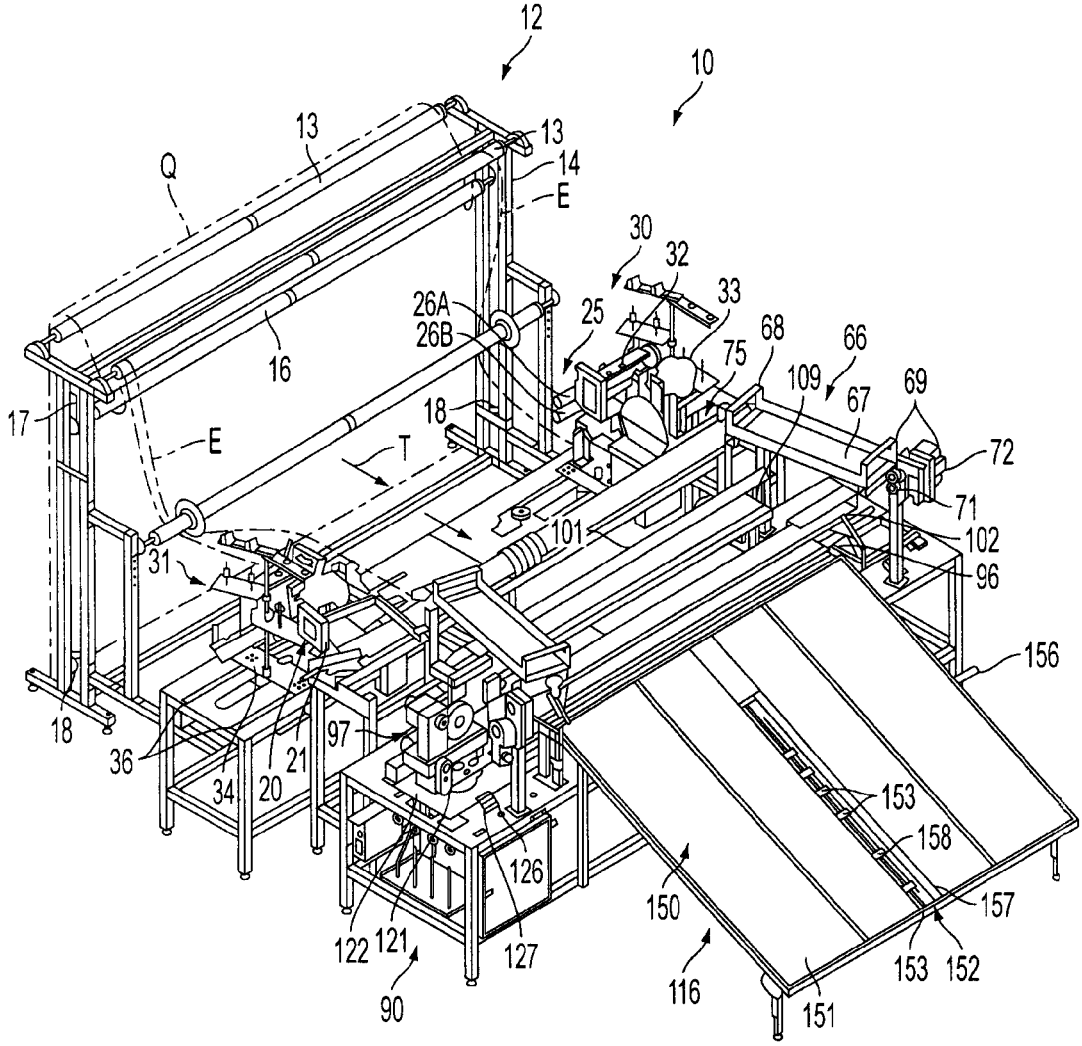
FIG. 2 is a perspective view of the automatic panel cutting and seaming system according to one embodiment of the present invention.

As generally illustrated in FIGS. 1 and 2, the quilted fabric material Q generally is fed initially through an accumulator 12, which accumulates an amount of quilted material thereon upstream from the automatic panel cutting and seaming system sufficient to form the largest size panel, i.e., a king sized mattress panel or similar panel, to be formed by the automatic panel cutting and seaming system 10. The accumulator thus ensures that an amount of material sufficient to complete a full panel is collected upstream prior to starting a cutting and seaming operation. The accumulator 12 generally includes a pair of spaced idler rolls 13 mounted on the upper end of a support frame 14, and a movable accumulator roll 16 that is mounted to the frame and is vertically movable from a lowered accumulating position, as indicated in FIG. 1, to a raised position indicated in FIG. 2. Sensors 17 and 18 detect the level of the accumulator roll during vertical movement of the accumulator roll within the frame. As the quilted material is pulled into the automatic panel cutting and seaming station, the accumulator roll generally is urged upwardly, and in response to the detection of such movement of the accumulator roll, additional material is fed into the accumulator until the accumulator roll has been moved back to its normal operating height, in order to ensure that a sufficient amount of accumulated material is maintained in the accumulator. The sensors 17, 18 also detect when the roll of material has run out and can signal 20 of the automatic panel cutting and seaming system 10 to alert an operator to change out the supply roll, or if there is an additional problem with the quilted material being fed into the accumulator and thus the automatic panel cutting and seaming assembly.

The system control 20 for the automatic panel cutting and seaming system 10 generally will be a computer-controlled control system including an operator interface such as a touch screen 21, keyboard or the like, as illustrated in FIG. 2. The system control generally also will include a memory for storing adjustment parameters as needed for adjusting the operative elements of the automatic panel cutting and seaming system for forming different size panels. The system control further can comprise a serial bus type control system such as disclosed in U.S. Pat. No. 6,295,481, the disclosure of which is incorporated herein by reference as if set forth in its entirety. Such a serial bus system can include control modules for each of the operative elements of the system, and with each of the control modules being programmed for operation of such an element or assembly, with such modules communicating in serial to the computer or processor of the system control. The system control 20 generally can be programmed to alert an operator as to improper operating conditions, such as the accumulator running out of accumulated quilted material, thread breakage, displacement of the quilted material passing through the automatic panel cutting and seaming system, and/or other fault conditions, and further can be programmed to immediately shut the automatic panel cutting and seaming system down in the event of the detection of certain fault conditions.

Figure 3:
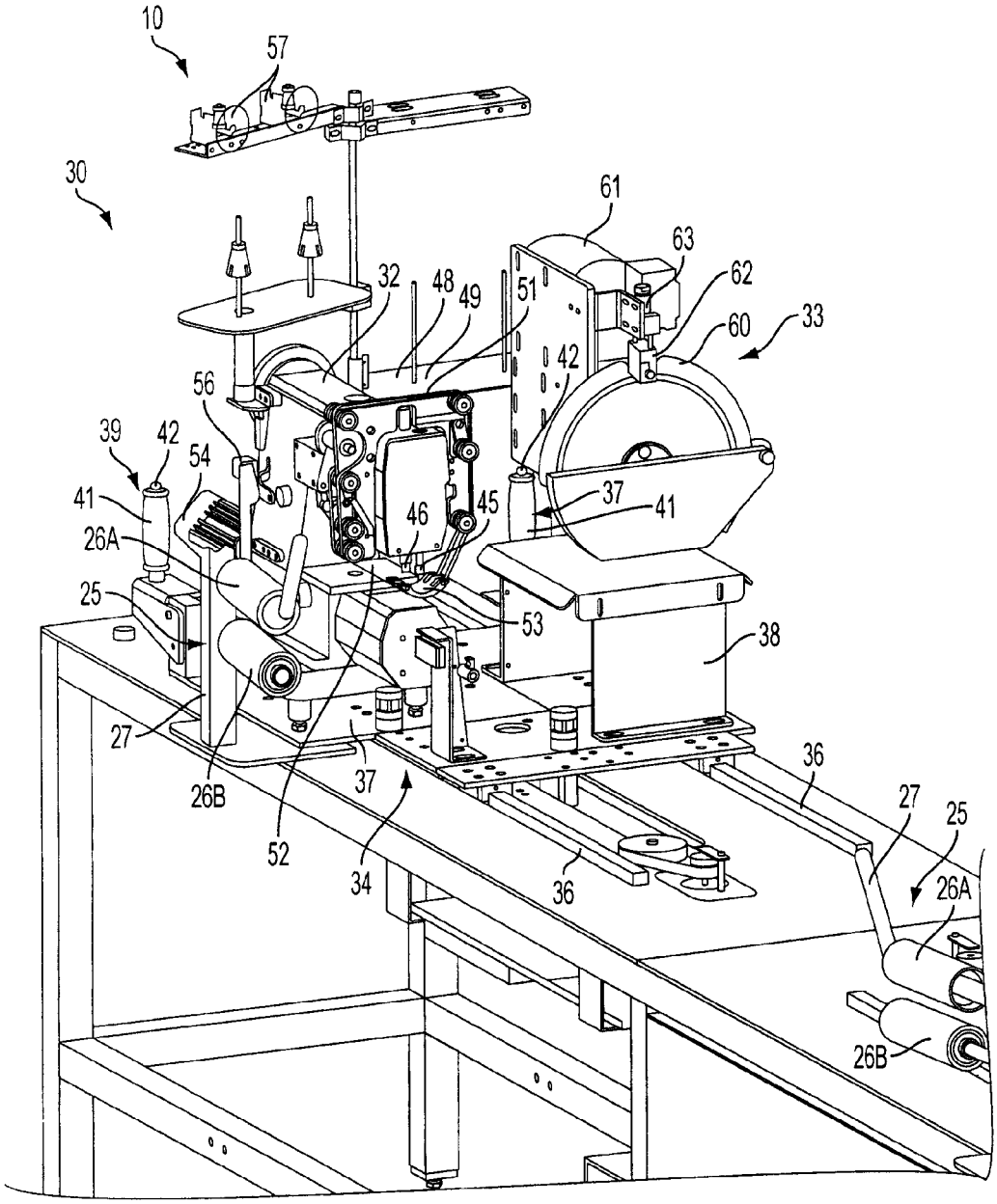
FIG. 3 is a perspective illustration of one of the side edge cutting and seaming assemblies of the automatic panel cutting and seaming system.

As indicated in FIGS. 1 and 2, the quilted material is fed from the accumulator 12 beneath a guide roller 23. Accumulator roll 16 induces and maintains a slight tension on the quilted material sufficient to keep the quilted material taut as it is fed into the automatic panel cutting and seaming system 10. The quilted material is fed from underneath the guide roller 23 into and through tension roller assemblies 25, which include pairs of spaced rollers 26A and 26B mounted on opposite sides of the path of travel T of the quilted material through the automatic panel cutting and seaming system. As illustrated in FIG. 3, the tension rollers generally include an upper roller 26A mounted on a movable arm or support 27, and a lower roller 26B spaced therefrom so as to define a gap or passage through which the side edge portion of the quilted material is passed. The arm or support 27 of the upper roller 26A generally is biased, such as by a cylinder, spring or other, similar mechanism 28 (FIG. 4), so as to urge the upper tension roller 26A toward the lower tension roller 26B. The biasing mechanism, such as gas shock cylinder 28 helps maintain a substantially constant pressure that urges the upper tension roller 26A downwardly so as to compress the side edge portion of the quilted material between the upper and lower tension rollers. The tension roller assemblies help flatten out and maintain the side edge portions E (FIG. 1) of the quilted material Q for cutting and seaming, and are mounted on each side of the path of the quilted material, with each of the tension roller assemblies generally being substantially mirror images of each other so as to engage the side edge portions of the quilted material substantially simultaneously as the quilted material is fed into the automatic panel cutting and seaming system.

Figure 4:
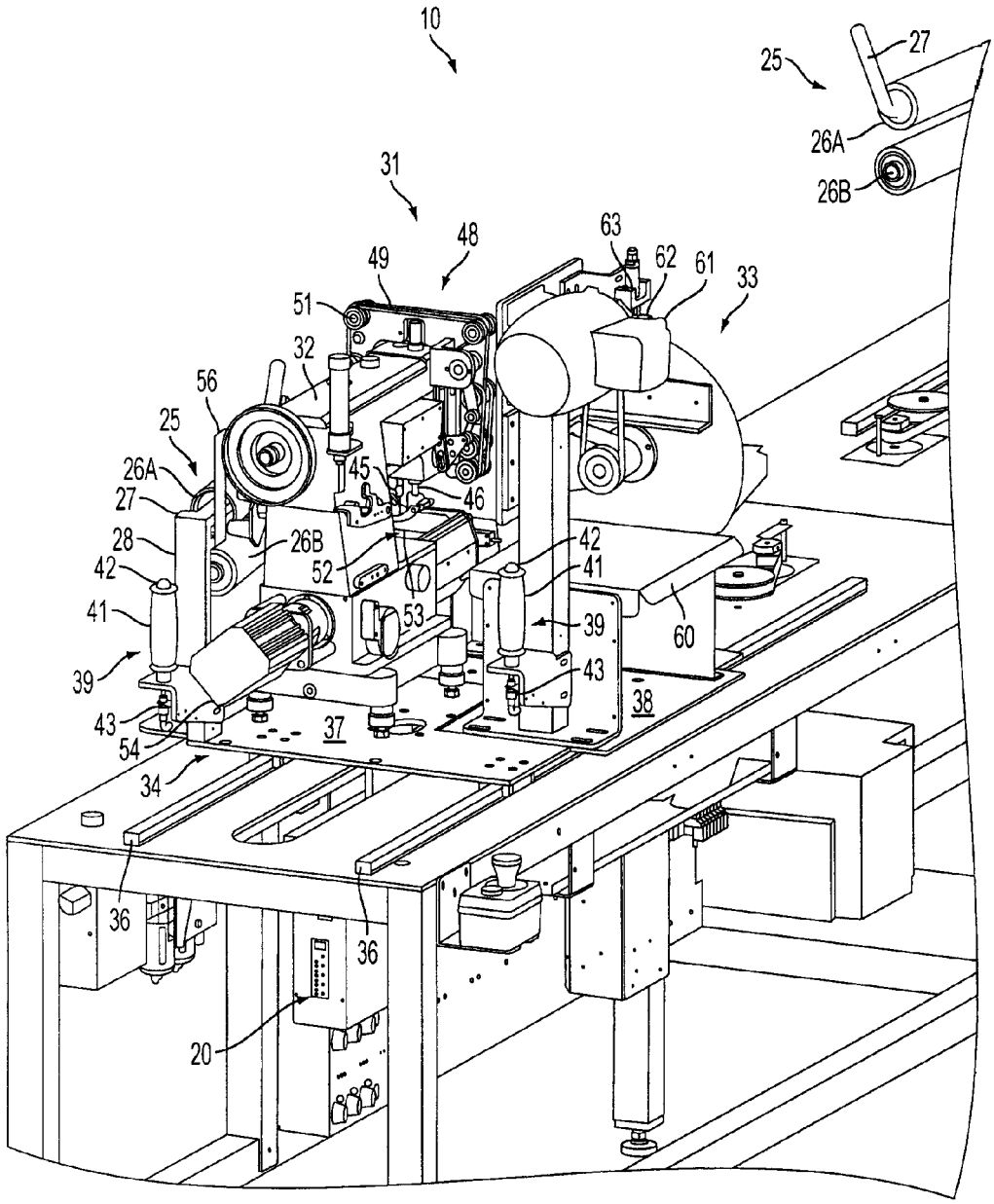
FIG. 4 is a perspective illustration of the downstream side of one of the side edge seaming and cutting assemblies.
Figure 5:
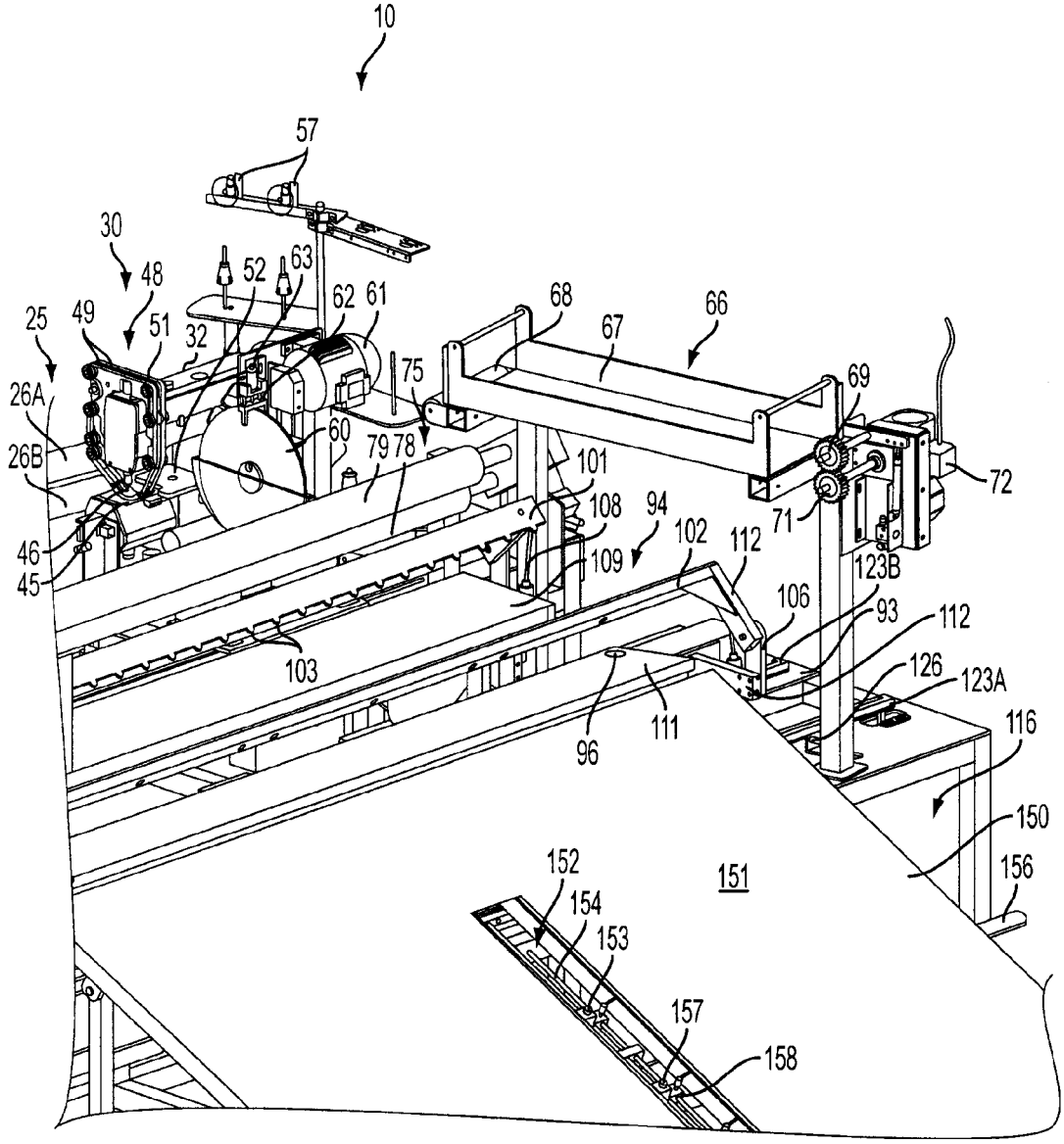
FIG. 5 is a perspective illustration of the table and side seam sewing assembly of the automatic panel cutting and seaming system.

As FIGS. 1 and 2 illustrate, the automatic panel cutting and seaming system 10 of the present invention further includes right and left hand side edge cutting and seaming assemblies 30/31 adapted to engage and trim and seam the side edges E of the quilted material Q. The side edge cutting and seaming assemblies 30 and 31 generally are mirror images of each other and are mounted on opposite sides of the path of travel T of the quilted material. As indicated in FIGS. 3-5, each side edge cutting and seaming assembly generally includes a side edge sewing machine 32 and an edge trimming assembly 33 behind the sewing machine 32, with the edge trimming assembly 33 and sewing machine 32 generally being mounted on a moveable carriage 34. The carriage 34 is movable along tracks 36, with its movement being controllable by the system control of the automatic panel cutting and seaming system, or manually as needed or desired. Still further, the sewing machine 32 is mounted on a first movable support or section 37 of the carriage 34, while the edge trimming assembly is mounted a second, separate support or portion 38 of the carriage 34, as indicated in FIG. 3. The support sections 37 and 38 for the sewing machine 32 and edge trimming assembly 33, respectively, each can be disengaged from the carriage separately as needed so as to enable independent movement of the sewing machine and edge trimming assembly of each side edge cutting and seaming assembly by engagement of a release mechanism 39. Each release mechanism 39 generally includes a handle 41 with a release switch or button 42 thereon. The button engages a valve 43 (FIG. 4), which enables the support section for either the sewing machine or the edge trimming assembly to be disengaged from the carriage and moved laterally away from the path of travel of the quilted material for ease of servicing of the sewing machine and/or edge trimming assembly.

For trimming and seaming the side edge portions of the quilted material, the right and left side edge cutting and seaming assemblies 31 and 32 (FIG. 2) generally will be moved together, in a coordinated movement toward or away from each other as needed to adjust the spacing therebetween for the desired panel width, i.e., king size, queen size, etc., to be formed. Thereafter, as the quilted material is received through the tension roller assemblies 25 (FIG. 3), its side edges are aligned with the sewing machine 32 for sewing/seaming and thereafter cutting. As illustrated in FIG. 3, each side-edge sewing machine generally is a dual needle sewing machine, although a single needle machine also can be used, typically including a pair of spaced sewing needles 45 and 46 generally forming one to two lines of stitching 47/47' (FIGS. 9A and 9B) adjacent the side edges E of the quilted material. A top belt drive mechanism 48, which typically includes a pair of spaced belts 49 driven by a series of drive rolls 51, generally is provided with each of the sewing machines 32 for engaging and pulling the quilted material through the sewing zone 52 and under the presser foot 53 of the sewing machine.

Each of the sewing machines generally is independently driven by its own servo motor 54, synchronized by the operation of the system control for the automatic panel cutting and seaming system. An edge sensor 56 generally is provided adjacent the sewing zone 52 and the tension roll assembly 25 for monitoring and detecting the side edge of the quilted material to ensure that there is sufficient material for cutting and seaming along the sides of the quilted material at each of the side edge cutting and seaming assemblies. If the sensor does not detect the edge of the quilted material, it signals the control system to alert the operator and/or shut down the operation of the automatic panel cutting and seaming system. Additionally, thread break detectors 57 (FIG. 3) further typically are provided for monitoring the feeding of the threads to the sewing needles of the sewing machines.

As illustrated in FIGS. 3-5, each of the edge trimming assemblies 33, is mounted downstream from its associated sewing machine 32, and typically includes a rotary trimmer or cutting blade 60 driven by motor 61 under control of the system control of the automatic panel cutting and seaming system. The cutting blade typically is arranged so as to cut along the side edge portion of the quilted material adjacent the outer line of stitching 47 (FIGS. 9A and 9B) scrap material, indicated by S in FIGS. 9A and 9B, from the seamed side edges of the quilted material. The edge trimming assemblies further can include automatic sharpeners 62 (FIG. 4) actuated by a cylinder or similar actuator 63 so as to engage and sharpen the outer cutting edge of the cutting blade 60. The scrap material S (FIGS. 9A and 9B) cut from the side edges E of the quilted material Q generally is fed upwardly and away from the path of travel T of the quilted material Q and into a tray 66 (FIGS. 2 and 5) downstream from the edge trimming assemblies. The trays generally include elongated containers or supports 67 with guide rollers 68 (FIG. 5) at the front end thereof for helping guide the scrap material into the trays. Drive rolls 69 and 71 are mounted at the opposite ends or rear ends of the trays 66 and generally comprise tooth rolls that engage in an intermeshing relationship so as to engage and pull the scrap material therethrough. One of the drive rolls, such as 69, generally is an idler roller while the other roll 71 generally is driven by a motor 72 so as to cause the motors to pull the scrap material from the trays and away from the operative elements of the automatic panel cutting and seaming system for disposal, such as using a vacuum system, collection bin or other mechanism.

Figure 6:
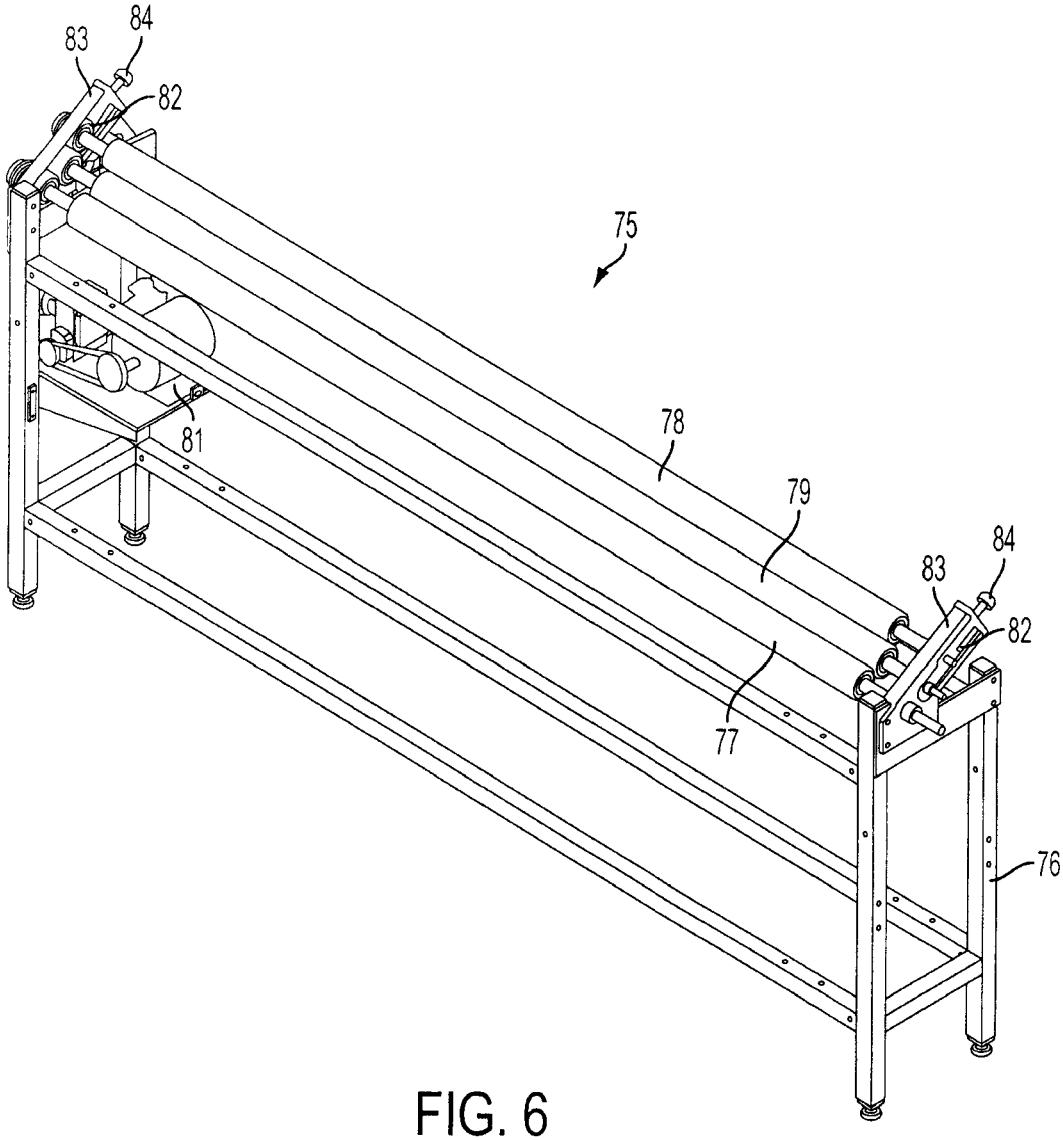
FIG. 6 is a perspective view of the puller roll assembly of the automatic panel cutting and seaming system.

As illustrated in FIGS. 2, 5 and 6, a puller roll assembly 75 generally is mounted downstream from the side edge cutting and seaming assemblies 31 and 32 (FIG. 2) and receives and pulls the side seamed quilted material through the automatic panel cutting and seaming system. As indicated in FIG. 6, the puller roll assembly generally includes a frame 76 on which are supported a series of puller rolls 77-79. Each of the puller rolls generally is covered with a tacky, non-stick and non-skid surface so as to be able to engage and pull the quilted material or ticking therethrough. One or more of the rolls 77-79, such as puller roll 78, typically is driven by a drive motor 81 mounted to the frame 76. In one embodiment, a chain drive mechanism (not shown) can drive all rolls together. The quilted material is received and wrapped around the puller rolls and is pinched between the driven puller roll 78 and the upper and lower puller rolls 79 and 77, respectively, at the upper and lower edges thereof for pulling the quilted material therethrough. Additionally, tension springs 82 or other, similar biasing mechanisms generally will be provided along end supports 83 and 84 at which the ends of the puller rolls 77-79 are supported. The tension applied by the springs 82 can be adjusted by hand screws 84, or could be automatically adjusted by the system control, to vary the amount of tension being applied between the puller rolls as needed for pulling quilted materials of varying thicknesses therethrough. The drive motor is controlled by the system control of the automatic panel cutting and seaming system so as to pull the quilted material along its path of travel T, as indicated in FIG. 1, through the side edge cutting and seaming assemblies, after which the puller roll assembly 75 feeds or urges the quilted material through a cross-cut sewing assembly to complete the formation of the mattress panels.

As illustrated in FIGS. 1 and 2, the cross-cut sewing assembly 90 typically can be mounted downstream from the side edge cutting and seaming assemblies 30 and 31 and the puller roll assembly 75 so as to cut and sew the leading and trailing edges of the panels P (FIG. 1) being formed by the automatic panel cutting and seaming system. Locating the cross-cut sewing assembly downstream from the side edge cutting and seaming assemblies can enable easier collection and disposal of the side edge waste since it does not have to be sewn and cut by the cross-cut sewing assembly, and this method also can provide further efficiencies in handling of the quilted material while it is still attached to the supply of quilted material versus the cutting and seaming of the side edges of the panels after they have been cut to length. Such an operation or configuration is schematically illustrated in FIG. 9A in which the quilted material is shown as being engaged by the side edge cutting and seaming assemblies 30/31 upstream from the cross-cut sewing assembly, so as to form the lines of stitching 47/47' therein, after which they will pass through the cross-cut sewing assembly 0 for cutting and sewing the trailing and leading edges 91 and 92, respectively, of a completed panel P and the next panel P to be formed. Alternatively, as indicated in FIG. 9B, is also possible to arrange the cross-cut sewing assembly upstream from the side edge cutting and seaming assemblies so that the panels are cut to length prior to their side edges being trimmed and seamed. Such an arrangement can help cut down on the amount of waste by reducing transitional waste, and allows for varying width panels to be run substantially at any time because of the location of the side edge cutting and seaming assemblies being downstream from the cross-cut sewing assembly.

Figure 7:
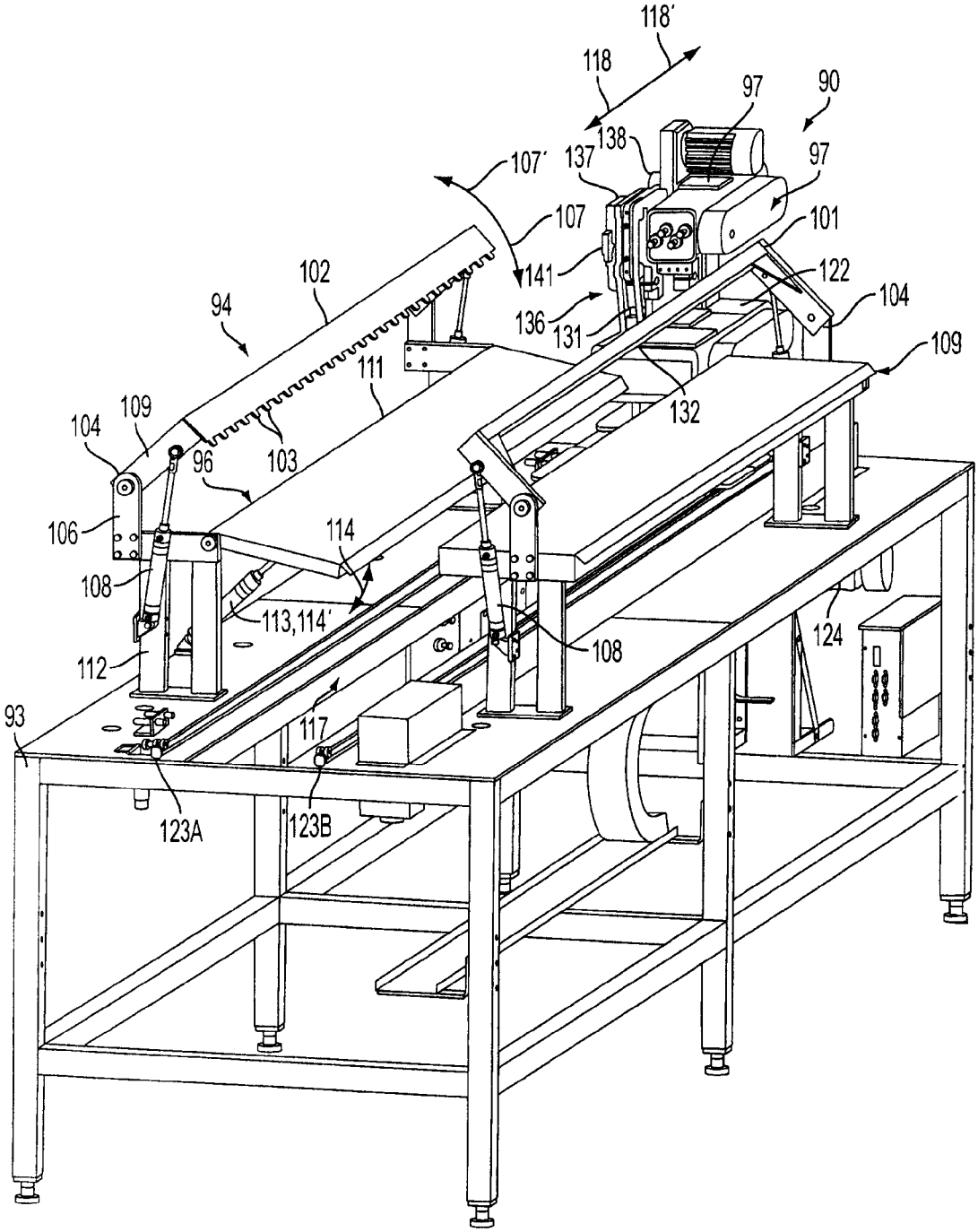
FIG. 7 is a perspective illustration of the cross-cut sewing assembly of the automatic panel cutting and seaming system.

FIG. 7 generally illustrates the cross-cut sewing assembly 90, which includes a frame 93 supporting a clamp assembly 94, a collapsible bridge 96 and a cross-cut sewing machine 97. The clamp assembly 94 generally includes a pair of clamp arms or bars 101 and 102 that each can have a series of spaced teeth 103 formed therealong to help grip and engage the quilted material. The rear ends 104 of each of the clamp arms 101 and 102 generally are pivotally mounted to opposite ends to or each to a clevis or similar support 106, so as to enable the clamp arms to pivot in the direction of arrows 107 and 107' during the clamping operation. Hydraulic or pneumatic cylinders 108 generally are mounted to each of the clamp arms at the right and left sides or ends thereof and are controlled by the system control of the automatic panel cutting and seaming system to cause the clamp arms to be pivoted as needed for clamping the quilting material during a cross-cutting and sewing operation. Additionally, an upstream support plate 109 is mounted beneath the upstream clamp arm 101 and provides a support over which the quilted material is fed and against which the quilted material can be clamped when the clamp arm 101 is in its lowered, clamping position.

The collapsible bridge 96 (FIG. 7) is mounted downstream from the support plate 109 and generally comprises elongated platform 111 that is pivotedly attached at its opposites ends to supports 112 for the downstream clamp arm 102. Cylinders 113 or similar actuators generally are connected to the platform 111 and are actuated by the system control to cause the collapsible bridge 96 to be pivoted in the direction of arrows 114 and 114' (FIG. 7) between raised and lowered positions. The bridge provides further support for the quilted material as it is fed thereover and on to a feed table 116 (FIG. 5) for measuring and supporting the free end of the quilted material as the quilted material is fed to a desired length for cross-cutting and seaming to form the resulted panel of a desired size, i.e., king size, queen size, etc. Once a length of quilted material for forming the desired length panel has been detected, then the clamp arms 101 and 102 are lowered into their clamping position, the collapsible bridge 96 generally is lowered or collapsed to its lowered position, so as to define a gap or passage 117 (FIGS. 5 and 7) between the upstream and downstream clamp arms 101 and 102, through which the cross-cut sewing head 97 can pass as it moves along its path of travel, indicated by arrows 118 and 118', across the width of the quilting material for cutting and seaming/sewing the leading and trailing edges of the cut panel and the next panel to be cut.

Figure 8:
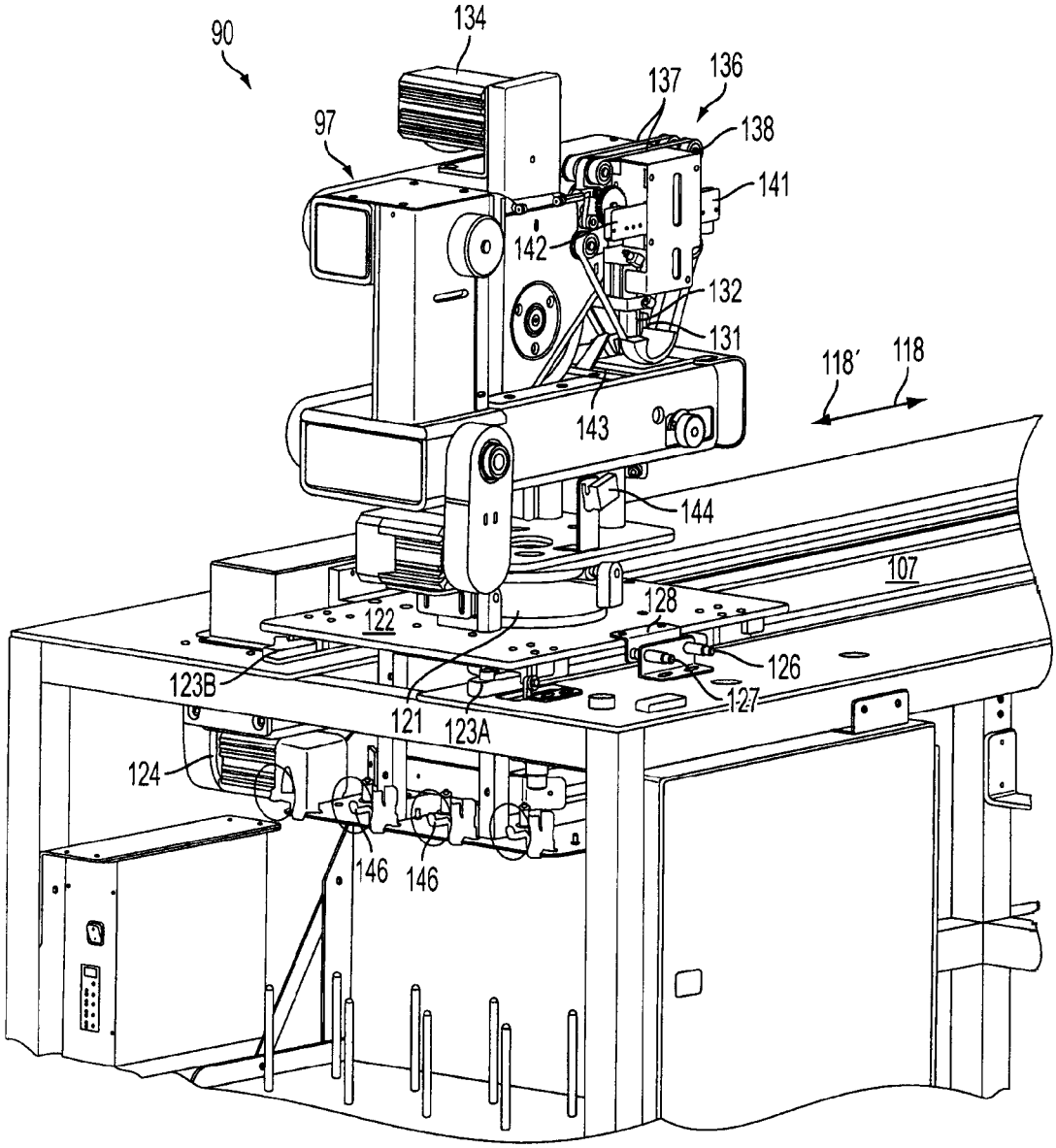
FIG. 8 is a perspective view of the sewing head and carriage of the cross-cut sewing assembly.
Figure 9B:
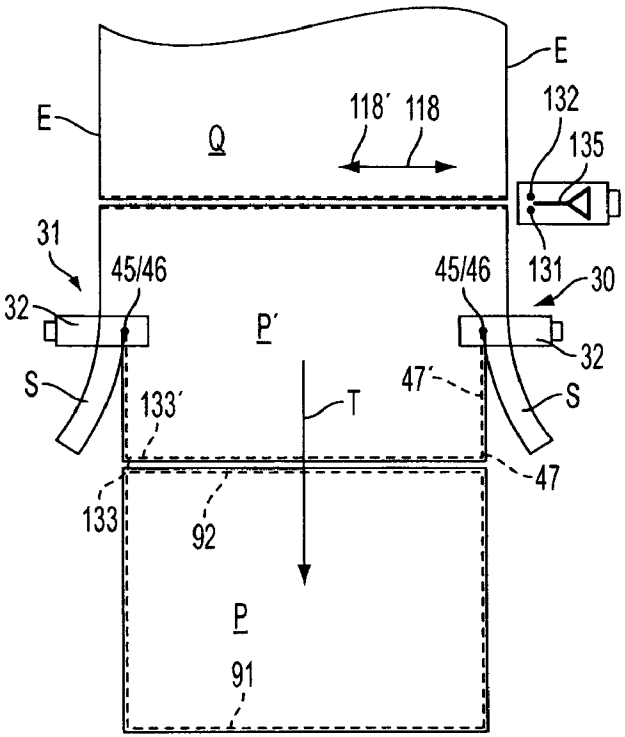
FIGS. 9A and 9B are schematic illustrations of the operations of example embodiments of the automatic panel cutting and seaming system according to the principles of the present invention.
Figure 9A:
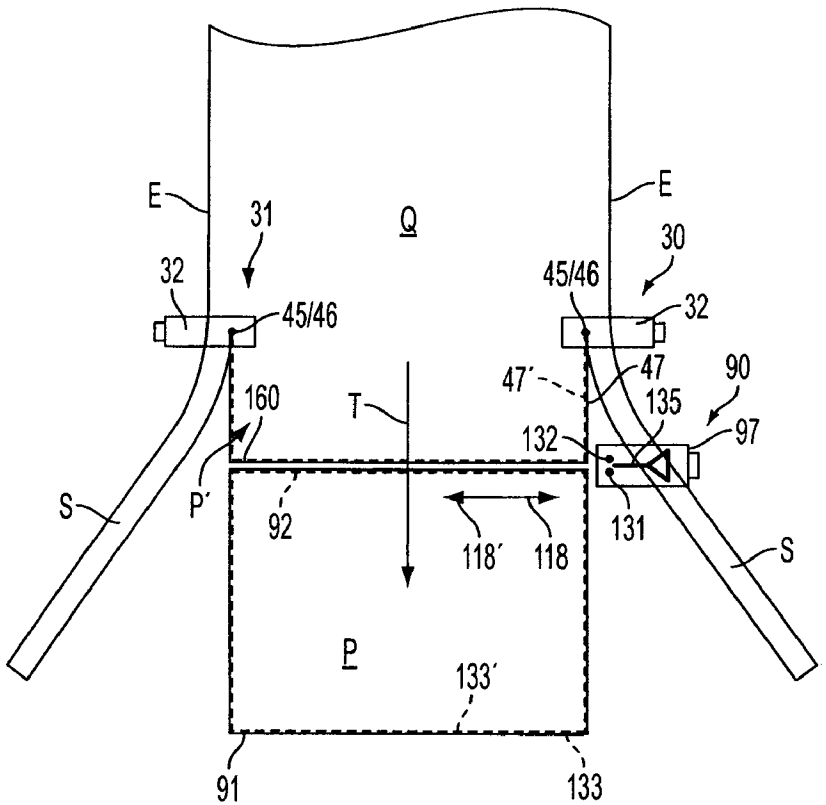

The cross-cut sewing head 97 is shown in further detail in FIG. 8. As indicated, the cross-cut sewing head generally is mounted on a turntable 121 that is pivotally mounted on a carriage 122 and enables pivoting or rotational movement of the cross-cut sewing head. The carriage is mounted on a pair of guide tracks 123A/B, which guide the carriage for movement of the cross-cut sewing head laterally in the direction of arrows 118 and 118' across the width of the quilted material during a cross-cutting and seaming operation. The carriage 122 generally is driven by a belt or similar drive controlled by reversible, variable speed motor 124 under control of the system control of the automatic panel cutting and seaming assembly. Pairs of sensors 126 and 127 generally are mounted adjacent the ends of the path of travel of the carriage for the cross-cut sewing head. The sensors 126 and 127 generally are proximity sensors or other detectors that sense the passage of a plate 128 attached to the carriage 122. Upon detection of the plate 128 by the first sensor 126 of each pair of sensors, the system control will be alerted to slow the movement of the carriage, and thus the cross-cut sewing head, for an impending stop. As the plate 128 is detected by the second sensor 127, the system control is alerted to stop the further movement of the carriage. Thereafter, the system control can actuate the turn table so as to cause the cross-cut sewing head to be pivoted approximately 180 degrees. This enables the cross-cut sewing head to be multi-directional so as to be capable of sewing in both directions as it is moved laterally across the width of the quilted material. Consequently, the cross-cut sewing assembly of the present invention does not need to be reset or moved back across the channel/passage 117 to a home or reset position after completing its cutting and sewing/seaming operation. Instead, the cross-cut sewing head is automatically reoriented and is ready to continue cutting and sewing the quilted material as it moves along its return path of travel. This enables greater efficiency in the formation and operation of the automatic panel cutting and seaming system as delays required by resetting of the cross-cut sewing assembly are substantially eliminated and potential alignment issues are minimized.

As illustrated in FIG. 8, the cross-cut sewing head 97 generally includes two pairs of spaced needles 131 and 132, although it is possible to utilize a single pair of spaced needles, which form two lines of stitching 133/133' (FIG. 9A) in the quilted material. A cutter 135 (FIGS. 9A-9B) generally is arranged between the pairs of needles 131 and 132 so as to cut or separate the quilted materials and form the panels P/P' as indicated in FIGS. 9A and 9B. As illustrated additionally in FIG. 8, the cross-cut sewing head generally is directly driven by a servo-motor 134, which further drives a dual top belt feed drive mechanism 136, including pairs of spaced drive belts 137 arranged on the outer sides of the pairs of needles of the cross-cut sewing head. The top feed drive belts 137 are engaged and driven by drive rollers 138 so as to engage and help pull the quilted material through the cross-cut sewing head as the cross-cut sewing head is moved along its path of travel across the quilted material. The use of the top belt drive assembly enables the thick quilted material to be engaged and pulled therethrough sufficiently to enable smoother feeding and cutting of the quilted material with potential for bunching or jamming of the quilted material being substantially minimized.

As indicated in FIG. 8, the cross-cut sewing assembly 90 further includes a pair of edge detectors or sensors 141 and 142 mounted to the sewing head at space locations in front of and behind the needles 131 and 132. Sensor 141 generally is a leading edge detection sensor, while sensor 142 is a trailing edge detection sensor. As the cross-cut sewing head moves across the quilted material, and edge sensor 141 detects the side edge of the quilted material, the operation of the sewing head can be slowed, and thereafter when the trailing edge sensor 142 detects the edge of the quilted material, it will actuate a cutter 143 that trims the thread to complete the cross-cut sewing operation. A needle position sensor 144 monitors a timing wheel or similar mechanism linked to the drive system for the needles of the cross-cut sewing head in order to determine the position of the needles for sewing. The needle position sensor 144 monitors and alerts the system control when the needles are in a lowered position prior to the start of a sewing operation so that the needles can be raised to an initial or start position prior to the initiation of a cross-cut sewing operation. Additionally, a series of thread breakage detectors 146 are mounted on the lower side of the carriage 122 for the cross-cut sewing head. The thread breakage detectors receive a series of sewing thread therethrough as the sewing threads are fed to the needles 131 and 132 and will alert the system control upon breakage or pulling back of the threads from the needles.

As illustrated in FIGS. 2 and 5, the feed table 116 is positioned immediately downstream from the cross-cut sewing assembly 90, and generally includes an elongated platform 150, which typically can be oriented at an angle with respect to the cross-cut sewing assembly. The platform 150 generally is of a size sufficient to support the largest size panel being formed by the automatic panel cutting and seaming assembly 10, and generally includes a smooth upper surface 151 over which the panels can slide as they are discharged from the automatic panel cutting and seaming system. Additionally, a slot or channel 152 generally is formed approximately along the center of the platform of the feed table as indicated in FIGS. 2 and 5. A series of sensors 153, which can include proximity sensors, photo-sensors and other similar detectors, typically are mounted along a moveable frame or rail to enable the adjustment of the location of the sensors 153, as an entire group, by operation of a handle and linkage 156. Alternatively, the position of individual sensors 153 can be adjusted by movement of their supports or housings 157 (FIG. 5) along the rail 154 and fixing their position via set screws 158 or similar fasteners. As the quilted material is fed through the clamp assembly 94 of the cross-cut sewing assembly 90 and covers the sensors, its length is detected and reported to the system control. After a desired length of the quilted material is detected, by passage of the end of the quilted material over the sensor 153 corresponding to the length or sized panel to be formed, the system control is notified and thereafter engages the cross-cut sewing assembly 90 to cut the panel to length.

In operation, as the quilted material Q (FIG. 1) is fed from a downstream quilting machine 11 or from another source, such as one or more supply rolls, it is accumulated on the accumulator 12 upstream from side edge cutting and seaming assemblies 30 and 31. The side edge cutting and seaming assemblies further are generally adjusted laterally with respect to the side edge of the quilted material by moving of their supporting carriages toward and away from each other as needed for forming different widths of panels. The accumulator generally accumulates a sufficient amount of quilted material to form at least one of the larger sized panels, i.e., a king size mattress panel, to be formed by the automatic panel cutting and seaming system 10. The quilted material is passed through the side edge cutting and seaming assemblies, with the edges E of the quilted material Q generally being engaged and pulled therethrough by the operation of the drive belts 49 (FIGS. 3-5) of the top belt feed drives 48 of the sewing machines 32 of the side edge cutting and seaming assemblies 30/31. As the quilted material is pulled through the side edge cutting and seaming assemblies, as indicated in FIG. 9A, one or more lines of stitching 47/47' generally will be formed in the quilted material, after which the quilted material is cut adjacent the outermost line of stitching by the edge trimming assemblies 33 so as to cut the panels to width along their seamed edges. The scrap materials generally are diverted from the sides of the quilted material to trays 66 (FIG. 5) and are pulled away therefrom by drive rolls 69 and 71 for collection and disposal.

The puller roll assembly 75 further urges or feeds the quilted material, with the side edges seamed and trimmed, as indicated in FIG. 9A, and to and through a cross-cut sewing assembly 90 (FIGS. 1, 2 and 7) for cutting the desired length panel. The quilted material generally is fed over the platform 111 and collapsible bridge 96 of the cross-cut sewing assembly 90, and thereafter passes along the feed table 116 (FIGS.

2 and 5) until a sensor 153 corresponding to the desired length panel to be cut is covered with the material indicating a desired length of quilted material has been fed through the system to form a desired size panel. The sensor signals the system control, which thereafter engages the cross-cut sewing assembly.

Upon actuation of the cross-cut sewing assembly, the feeding of the quilted material by the puller roll assembly is temporarily halted while the clamp arms 101 and 102 of the clamp assembly 94 are engaged so as to clamp the quilted material therebetween and hold the quilted material target for cutting. At approximately the same time, the collapsible bridge 96 is lowered to its collapsed or retracted position thus defining passage 117 (FIGS. 5 and 7) for the movement of the cross-cut sewing head 97 therealong. The cross-cut sewing head generally is moved laterally across the quilted material in the direction of arrows 118 or 118', with the quilted material being engaged and pulled through the cross-cut sewing head by the operation of the drive belts 137 of the dual top belt feed drive mechanisms 136.

Typically, four lines of stitching 133 (FIGS. 9A-9B) will be formed across the quilted material by the cross-cut sewing head, with the lines of stitching 133 intersecting the lines of stitching 47/47' (FIG. 9A) previously formed by the side edge cutting and seaming assemblies. The quilted material also will be severed or cut laterally between the two pairs of lines of stitching 133 by the cutter of the cross-cut sewing head to cut the panel to length. Thus, the cross-cut sewing head cuts and seams the trailing edge 90 of the panel P being formed, as well as forms the leading edge of the next panel P' to be formed. As the cross-cut sewing head approaches the end of its path of travel 118, its supporting carriage is detected by a first sensor 126 (FIGS. 7-8), which alerts the system control and causes the movement of the carriage to be slowed, after which, upon detection the carriage by a second sensor 127, the further motion of the carriage is halted, and the turntable 121 for the cross-cut sewing head then is engaged to rotate the cross-cut sewing head approximately 180° to reorient the cross-cut sewing head for sewing back across the quilted material in a return motion 118'. Thus, the cross-cut sewing head is multi-directional in its operation, which can significantly enhance or speed up the raw cutting and seaming operation performing the panels.

It will also be understood that the cross-cut sewing assembly 90 can be located at varying positions, upstream or downstream from the side edge cutting and seaming assemblies as shown in FIGS. 9A-9B. In an alternative operation illustrated in FIG. 9B, the panels can be first cut to a desired length, and thereafter have their side edges seamed and trimmed.

Once completed, the process utilizing the present invention results in mattress panels formed as substantially perfectly sized rectangular panels designed to fit desired size mattresses, such as king, California king, queen, double, etc. size mattresses, and with each panel further having substantially constant, neat, oversewn seams along all four sides of the resultant quilted panel. The quilted panels thereafter can be collected and transferred to further downstream sewing stations or operations, such as a flanging or border attachment station.

It will be understood by those skilled in the art that while the present invention has been described above with reference to various embodiments, numerous additions, modifications, and variations also can be made thereto without departing from the spirit and scope of the present invention.

We claim:

1. A system for cutting and seaming a fabric material to form a series of fabric panels, comprising:

a pair of side edge cutting and seaming assemblies, each comprising:

a sewing machine having at least one sewing needle forming a line of stitching adjacent a side edge of the fabric material and at least one top belt feed drive for engaging and pulling the fabric material through said sewing machine; and an edge trimming blade downstream from said sewing machine and adapted to cut the side edge of the fabric material adjacent the line of stitching formed along the side edge by said sewing machine;

a puller roll assembly mounted downstream from said side edge sewing assemblies and including a series of puller rolls for engaging and pulling the fabric material through said side edge cutting and seaming assemblies; and a cross-cut sewing assembly comprising:

a cross-cut sewing head movable across the fabric panel for cutting and sewing across a width of the fabric material to form downstream and upstream edges of leading and trailing panels, respectively, and including at least two sewing needles, a cutter, and a top belt feed drive mechanism for engaging and pulling the fabric material through said cross-cut sewing head during a leading/trailing edge cutting and seaming operation.

2. The system of claim 1 and further comprising an accumulator upstream from said sewing machines of said side edge cutting and seaming assemblies.

3. The system of claim 1 and wherein said cross-cut sewing assembly further comprises a carriage moveable along a path of travel across the width of the fabric material and having a turntable on which said cross-cut sewing head is mounted, wherein said cross-cut sewing head is pivotable approximately 180° to enable said cross-cut sewing head to sew in multiple directions across the fabric material.

4. The system of claim 3 and further comprising a series of sensors mounted at opposite ends of the path of travel of carriage for controlling movement of said carriage as it reaches each end of its path of travel.

5. The system of claim 4 and wherein said series of sensors comprises pairs of sensors mounted at the opposite ends of the path of travel of said carriage, including a first sensor for slowing movement of said carriage and a second sensor stopping said carriage.

6. The system of claim 1 and wherein said sewing machines of said side edge cutting and seaming assemblies each comprise a pair of spaced top belt feed drives and a pair of sewing needles for forming outer and inner lines of stitching along the side edge portion of the fabric material.

7. The system of claim 1 and wherein said cross-cut sewing head comprises two spaced pairs of sewing needles arranged on upstream and downstream sides of said cutter for forming at least two lines of stitching along the upstream and downstream edges of leading and trailing panels.

8. The system of claim 1 and further comprising a feed table downstream from said cross-cut sewing assembly for receiving cut panels thereon, and including a series of sensors mounted at spaced locations for detecting various lengths of the fabric material and actuating said cross-cut sewing assembly upon detection of a desired length of fabric material being fed thereon.

9. The system of claim 1 and further comprising tension rollers upstream from said side edge cutting and seaming assemblies for engaging and guiding side edge portions of the fabric material into said side edge cutting and seaming assemblies.

10. The system of claim 1 and wherein said side edge cutting and seaming assemblies further comprise sensors for detecting side edge portions of the fabric material to ensure a sufficient amount of fabric material is fed to said sewing machines of said side edge cutting and seaming assemblies for cutting and seaming.

11. An automatic panel cutting and seaming station for cutting and seaming mattress panels from a supply of a fabric material, comprising:

a pair of side edge cutting and seaming assemblies mounted on opposite sides of a path of travel of the fabric material, each including a sewing machine forming at least one line of stitching adjacent a side edge of the fabric material, and an edge trimming blade associated with the sewing machine and arranged to trim a side edge of the fabric material adjacent the at least one line of stitching;

a puller roll assembly downstream from the side edge cutting and seaming assemblies for drawing the fabric material therethrough; and a cross-cut sewing assembly having a multi-directional cross-cut sewing head pivotally mounted on a carriage so as to be moveable laterally across the fabric material and to be pivotable for reorienting the cross-cut sewing head for cutting and sewing in an opposite direction to form a trailing edge of each panel.

12. The automatic panel cutting and seaming station of claim 11 and wherein the sewing machine and edge trimming blade of each side edge cutting and seaming assembly are mounted on a carriage so as to be moveable laterally toward and away from the adjacent side edge of the fabric material as needed for cutting and seaming the side edges of a mattress panel of a desired size.

13. The automatic panel cutting and seaming station of claim 12 and further comprising release mechanisms connected to supports for the sewing machine and trimming blade of each side edge cutting and seaming assembly for disconnecting the supports from the carriage and enabling independent movement of the sewing machine and edge trimming blade.

14. The automatic panel cutting and seaming station of claim 11 and further comprising a series of sensors mounted at opposite ends of the path of travel of carriage for controlling movement of the carriage as it reaches each end of its path of travel.

15. The automatic panel cutting and seaming station of claim 14 and wherein the series of sensors comprises pairs of sensors mounted at the opposite ends of the path of travel of said carriage, including a first sensor for slowing movement of said carriage and a second sensor stopping said carriage.

16. The automatic panel cutting and seaming station of claim 11 and wherein the sewing machines of said side edge cutting and seaming assemblies each comprise a pair of spaced top belt feed drives and a pair of sewing needles for forming outer and inner lines of stitching along the side edge portion of the fabric material.

17. The automatic panel cutting and seaming station of claim 11 and further comprising an accumulator upstream from said sewing machines of the side edge cutting and seaming assemblies.

18. The automatic panel cutting and seaming station of claim 11 and wherein said cross-cut sewing head comprises two pairs of sewing needles spaced apart and arranged on upstream and downstream sides of the cutter for forming at least two lines of stitching along the upstream and downstream edges of the leading and trailing panels.

19. The automatic panel cutting and seaming station of claim 11 and further comprising a table downstream from the cross-cut assembly and having a series of sensors for detecting a desired length of the fabric material being received thereon, and in response to which the cross-cut assembly will be arranged to cut the fabric material for forming a panel of a desired size.

20. The automatic panel cutting and seaming station of claim 19 and further comprising a moveable support rail on which the series of sensors of the table are mounted at spaced locations for adjusting positions of the sensors as needed for detecting various lengths of the fabric material being fed.

* * * * *

UNITED STATES PATENT AND TRADEMARK OFFICE

CERTIFICATE OF CORRECTION

PATENT NO. : 8,042,478 B2
APPLICATION NO. : 12/207819
DATED : October 25, 2011
INVENTOR(S) : Warren Oxley et al.

It is certified that error appears in the above-identified patent and that said Letters Patent is hereby corrected as shown below:

On the title page, item (75), the spelling of the Inventors' names should be corrected and listed as Warren Oxley, John S. Chamlee, Van H. Nguyen and Danny V. Murphy. The first inventor's name is currently incorrectly spelled on the issued patent as "Warran Oxley."

Signed and Sealed this
Sixth Day of December, 2011

David J. Kappos

David J. Kappos
*Director of the United States Patent and Trademark Office*